United States Patent [19]

Noordermeer

[11] Patent Number: 4,748,372

[45] Date of Patent: May 31, 1988

[54] COLOR DISPLAY TUBE

[75] Inventor: Leendert J. Noordermeer, Eindhoven, Netherlands

[73] Assignee: U.S. Philips Corporation, New York, N.Y.

[21] Appl. No.: 940,214

[22] Filed: Dec. 8, 1986

Related U.S. Application Data

[63] Continuation of Ser. No. 659,067, Oct. 9, 1984, abandoned.

[30] Foreign Application Priority Data

Jul. 20, 1984 [NL] Netherlands ..... 8402303

[51] Int. Cl.[4] ..... B65B 21/02

[52] U.S. Cl. ..... 313/413; 313/411; 313/412; 313/417; 313/409

[58] Field of Search ..... 313/412, 413, 414, 411, 313/417, 409

[56] References Cited

U.S. PATENT DOCUMENTS

| | | | |
|---|---|---|---|
| 3,866,080 | 2/1975 | Barkow | 313/412 |
| 4,142,131 | 2/1979 | Ando et al. | 313/412 |
| 4,196,370 | 4/1980 | Hughes | 313/412 |
| 4,208,610 | 6/1980 | Schwartz | 313/414 |
| 4,625,145 | 11/1986 | Gerritsen et al. | 313/413 |
| 4,634,923 | 1/1987 | Alig | 313/413 |

FOREIGN PATENT DOCUMENTS

| | | | |
|---|---|---|---|
| 2545718 | 7/1976 | Fed. Rep. of Germany | 313/413 |
| 3212248 | 10/1983 | Fed. Rep. of Germany | 313/414 |
| 0051863 | 4/1977 | Japan | 313/412 |
| 0172637 | 10/1982 | Japan . | |
| 0172636 | 10/1982 | Japan . | |
| 0046557 | 3/1983 | Japan | 313/414 |

*Primary Examiner*—David K. Moore
*Assistant Examiner*—Michael Razavi
*Attorney, Agent, or Firm*—Robert J. Kraus

[57] ABSTRACT

Coma correction means is provided in a color display tube including an evacuated envelope (1) containing an electron gun system (5) of the "in-line" type to generate three electron beams (6, 7, 8) situated with their axes in one plane. The electron beams converge on a display screen (10) provided on a wall of the envelope and are deflected over the display screen in two mutually perpendicular directions by means of a first and a second deflection field. The first deflection field is parallel to the plane. The electron gun system includes at its end field shapers (34, 35) for causing the frames described on the display screen by the electron beams to substantially coincide the field shapers include substantially annular elements (34) of a material having a high magnetic permeability around the two outermost beams. Two elongate flat strips (35) of a material having a high magnetic permeability are provided symmetrically with respect to the axis (37) of the central beam and the plane through the beam axes. Each strip has a longitudinal axis (L) substantially perpendicular to the plane, intersecets the plane extends with its a width axis (B) in the direction of the display screen (10), and has a recess (38) adjacent the central beam aperture (32).

8 Claims, 2 Drawing Sheets a b a b a b c d

COLOR DISPLAY TUBE

This is a continuation of application Ser. No. 659,067, filed Oct. 9, 1984 and now abandoned.

BACKGROUND OF THE INVENTION

The invention relates to a colour display tube comprising in an evacuated envelope an electron gun system of the "in-line" type to generate three electron beams situated with their axes in one plane. The electron beams converge on a display screen provided on a wall of the envelope and, in the operating condition of the display tube, are deflected over the display screen in two mutually perpendicular directions by means of a first and a second deflection field. The direction of the first deflection field is parallel to the plane. The electron gun system comprises at its end field shapers to cause the frames described on the display screen by the electron beams to coincide as much as possible. The field shapers comprise substantially annular elements of a material having a high magnetic permeability and positioned around the two outermost beams.

Such a colour display tube is disclosed in U.S. Pat. specification No. 4,196,370. A frequently occurring problem in colour display tubes having an electron gun system of the "in-line" type is line coma and field coma, which causes the dimensions of the frames described on the display screen by the three electron beams to be different. This is the result of the eccentric location of the outermost electron beams with respect to the field for the horizontal and vertical deflections, respectively. In the above-mentioned Patent Specification a large number of Patents are mentioned in which partial solutions are given. These solutions consist of using rings and plates for conducting and/or screening magnetic fields which are mounted at the gun end and which intensify or weaken the deflection field or the deflection fields locally along a part of the paths of the electron beams.

For the deflection of the electron beams in colour display tubes various types of coils are used. In tubes having an "in-line" electron gun system, the coils usually are self-converging. One of the much used types of coils is the so-called hybrid coil. Thus consists of a saddle-shaped line coil and a toroidal field coil. As a result of the winding method used for the manufacture of the field coil it is not possible to make the coil so as to be entirely self-converging. A winding distribution is usually chosen which is such that a given convergence error remains, the so-called coma. This coma error is evidenced, for example, by a larger frame (horizontal and vertical) for the outermost beams than for the central beam. The horizontal and vertical deflections of the central beam are smaller than those of the outermost beams. As described in the U.S. specification No. 4,196,370, this is corrected inter alia by providing around the outermost beams annular elements of a material having a high magnetic permeability (for example, of mu-metal). As a result of these elements, the edge field produced by the field deflection coil is screened somewhat at the area of the outermost electron beams, as a result of which these beams are deflected slightly less and the coma error is reduced.

There also exist deflection coils having convergence errors in which the frame of the central electron beam is too large horizontally and is too small vertically. Correction is obtained, for example, by strip-shaped field shapers as described in U.S. specification No. 4,142,131 which may be deemed to be incorporated herein by reference.

With some deflection coils, removal of the horizontal coma error, causes overcompensation of the vertical coma error, so that vertically a new coma error of opposite sign is formed.

SUMMARY OF THE INVENTION

It is therefore an object of the invention to provide a display tube in which it is possible to compensate the horizontal and vertical coma errors more or less independently of each other.

In accordance with the invention, a display tube of the kind mentioned in the opening paragraph is characterized in that two elongate flat strips of a material having a high magnetic permeability are provided symmetrically with respect to the axis of the central beam and the plane through the beam axes, with their longitudinal axes substantially perpendicular to the plane. The strips intersect the plane, extend with their width axes in the direction of the display screen, and each have a notch or recess adjacent the central beam aperture. By providing the recesses adjacent the central electron beam, the electrons in the central electron beam are in the field between the two strips (the field deflection field) for a shorter period of time, as a result of which the central beam will be deflected less in the vertical direction, while sufficient correction is still obtained for the line field.

A first preferred embodiment of a display tube in accordance with the invention is characterized in that each ring around the outermost electron beans forms one assembly with the nearest strip. By causing the strips to enclose an angle with the axis of the central beam, the amount of coma correction can be adjusted in a simple manner. The angle is preferably at most 45° from the axis.

BRIEF DESCRIPTION OF THE DRAWING

The invention will now be described in greater detail with reference to a drawing, in which.

DESCRIPTION OF THE PREFERRED EMBODIMENTS

Figure 1:
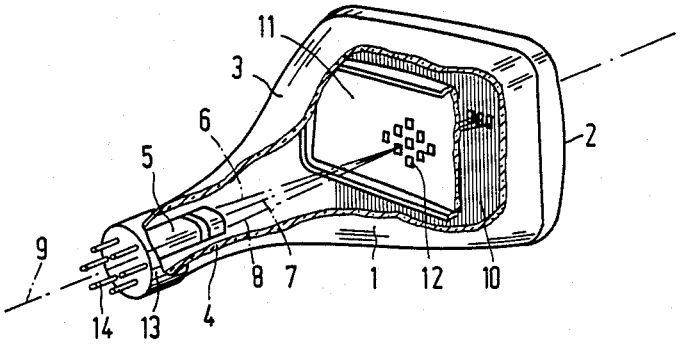
FIG. 1 is a perspective view, broken away, of a display tube according to the invention.

FIG. 1 is a perspective view of a color display tube of the "in-line" type according to the invention. An integrated electron gun 5 generates three electron beams 6, 7 and 8 which, prior to deflection, are situated with their axes in one plane. The gun is provided in the neck of a glass envelope 1 which is composed of a display window 2, a cone 3 and the neck 4. The axis of the central electron beam 7 coincides with the tube axis 9.

The display window 2 comprises on its inside a plurality of triplets of phosphor lines. Each triplet comprises a line consisting of a blue-luminescing phosphor, a line consisting of a green-luminescing phosphor, and a line consisting of a red-luminescing phosphor. All triplets together constitute the display screen 10. The phosphor lines are substantially perpendicular to the plane through the beam axes. The shadow mask 11 is provided in front of the display screen and comprises a very large number of apertures 12 through which the electron beam 6, 7 and 8 pass which each impinge only on phosphor lines of one colour. The three electron beams situated in one plane are deflected by a system of deflection coils not shown. The tube comprises a tube cap 13 having connection pins 14.

Figure 2:
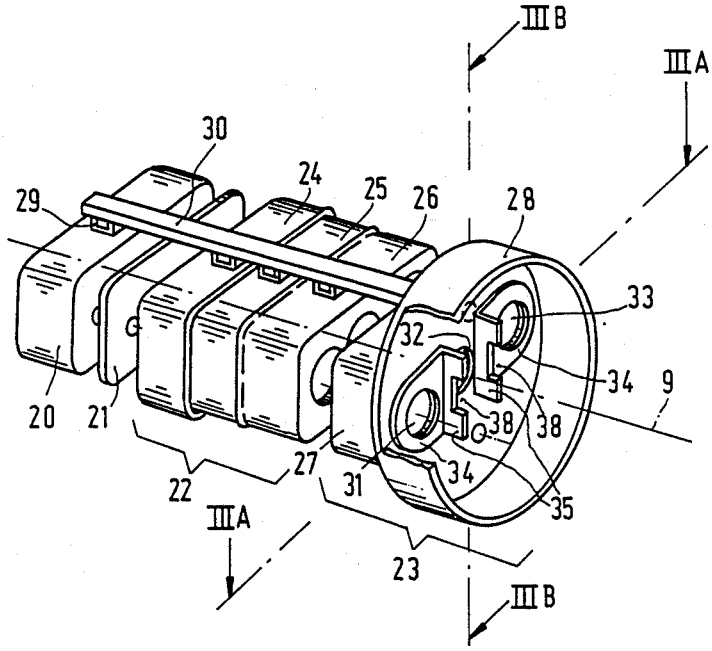
FIG. 2 is a perspective view of an electron gun system for the tube shown in FIG. 1.

FIG. 2 is a perspective view of an embodiment of an electron gun system as used in the colour display tube shown in FIG. 1. The electron gun system comprises a common cup-shaped control electrode 20 in which three cathodes (not visible) are connected, and a common plate-shaped first anode 21. The three electron beams situated with their axes in one plane are focused by means of the second anode 22 and the third anode 23 which are common for the three electron beams. Anode 22 consists of three cup-shaped parts 24, 25 and 26. The parts 25 and 26 are connected together at their open ends. Part 25 is positioned coaxially in part 24 without any mechanical contact. Anode 23 comprises one cup-shaped part 27 the bottom of which, like the bottoms of the other cup-shaped parts, is provided with apertures. Anode 23 moreover comprises a centering sleeve 28 which is used for centering the electron gun system in the neck of the tube. The centering sleeve comprises centering springs which are not shown. The electrodes of the electron gun system are connected together in the usual manner by means of braces 29 and glass rods 30.

The bottom of the centering sleeve 28 comprises three apertures 31, 32 and 33. Around the apertures 31 and 33 which pass the outermost electron beams, substantially annular field shapers 34 are provided which form one assembly with strips 35 which are provided on each side of aperture 32 and which comprise notches or recesses 38 adjacent the electron beam aperture 32. The recesses 38 may have different depths and shapes dependent on the deflection coils used, the gun type and the desired correction.

Figure 3:
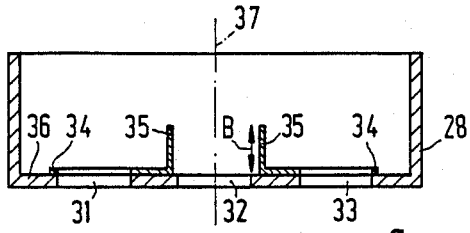
FIG. 3*a* is a horizontal sectional view through a part of FIG. 2.
FIG. 3*b* is a vertical sectional view.
Figure 3:
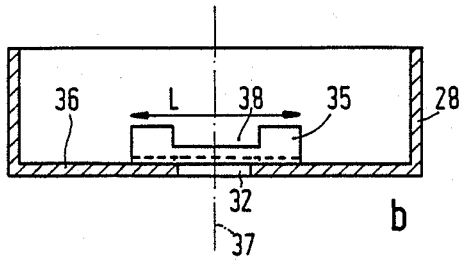

FIG. 3*a* is a sectional view through the centering sleeve 28 in which the plane through the beam axes is the plane of the drawing. Connected against the bottom 36 of the centering sleeve around the apertures 31 and 33 are the annular elements 34 which form one assembly with the substantially elongate strips 35 extending with their longitudinal axis (L) perpendicularly to the plane through the beam axes. These strips extend from the bottom 36 with their width axis (B) in the direction of the display screen.

FIG. 3*b* is a sectional view at right angles to the sectional view shown in FIG. 3*a*. Two elongate strips 35 of mu-metal are situated symmetrically with respect to the axis 37 of the central electron beam and comprise a recess 38 adjacent the central electron beam aperture. In a tube having a neck diameter of 22.4 mm, the centering sleeve is 10 mm deep and has an outside diameter of 15.3 mm and an inside diameter of 14.8 mm. The spacing between the centers of two juxtaposed apertures in the bottom 36 is 4.4 mm. The annular elements 34 and the strips 35 are punched from 0.25 mm thick mu-metal sheet material. The elongate strips 35 have a length of 10 mm and at their ends are 1.5 mm wide. The recess 38 in this case is rectangular and has a length of 4 mm and a depth of 1.3 mm.

Figure 4:
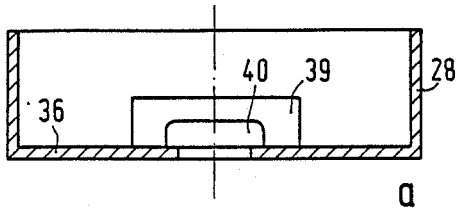
FIG. 4*a* is a sectional view analogous to FIG. 3*b* of another embodiment according to the invention.
FIG. 4*b* is a sectional view analogous to FIG. 3*a* of another embodiment in accordance with the invention.
Figure 4:
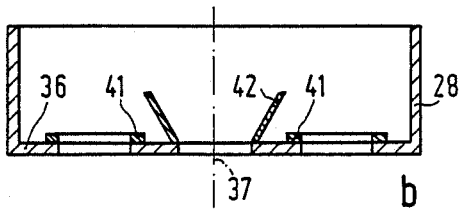

FIG. 4*a* is a sectional view analogous to the sectional view of FIG. 3*b* of another embodiment of the strips. In this case each strip 39 has a recess 40 on the side facing the bottom 36 of the centering sleeve. The recess 40 has rounded corners. However, the recess may also be V-shaped or may be provided in the strip in the form of an aperture.

FIG. 4*b* is a sectional view analogous to the sectional view of FIG. 3*a*. The substantially annular elements in this case consist of 0.25 mm thick flat rings 41 which are not connected to the strips 42 having recesses. The strips 41 are placed at an angle of 15° to the axis 37 of the central electron beam and are connected to the bottom 36 by means of spot-welds.

Figure 5:
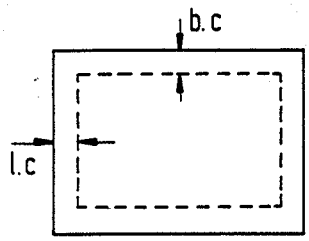
FIGS. 5*a*, 5*b*, 5*c* show the line coma and field coma produced by a number of coils.
FIG. 5*d* illustrates the overcompensation of the field coma by prior art field shapers.
Figure 5:
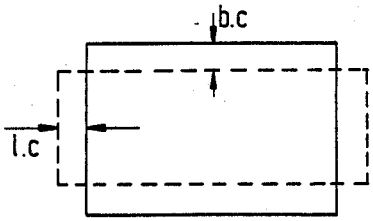
Figure 5:
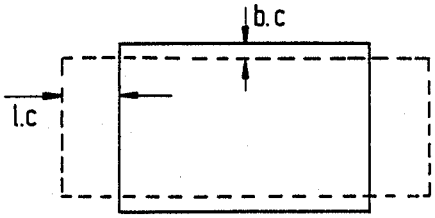
Figure 5:
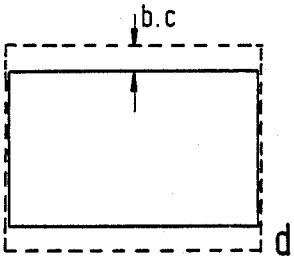

FIG. 5*a* shows the frames of the outermost electron beams and the central beam as a solid line and as a broken line, respectively, in a tube without field shapers and having a self-converging deflection coil. bc denotes the field coma and lc the line coma. Deflection coils are also known in which the frames for the outermost beams and the central beam are as is shown in FIG. 5*b* or c. Correction of the coma with so far known means resulted in the overcompensation of the field coma shown in FIG. 5*d*. By using recesses in the strips, as shown in the FIGS. 2, 3 and 4, overcompensation is avoided and it is possible to cause the frames to coincide substantially entirely.

What is claimed is:

1. A color display tube comprising an envelope containing a display screen and an electron gun system for producing a central electron beam and first and second outer electron beams having respective axes which lie in a single plane and converge toward a point on the screen, the electron gun system including a plate at an end thereof including a central aperture and first and second outer apertures from which the respective electron beams exit into a deflection field region of the envelope;

characterized in that said plate includes coma-correcting field shapers disposed on a surface of the plate facing the screen for correcting line and field coma, said field shapers including first and second elements of high magnetic permeability material disposed adjacent the first and second outer apertures, respectively, each of said field shapers comprising:

(a) a plate-shaped portion surrounding the respective aperture and lying flat on said surface of the plate; and (b) an upstanding elongate portion disposed between the respective aperture and the central aperture, said respective elongate portion;

(1) extending transversely of the plane containing the electron beam axes and terminating in end portions on opposite sides of said plane which extend substantially beyond the central aperture;

(2) being positioned closer to the central aperture then to the respective outer aperture, at least where the upstanding elongate portion joins the plate-shaped portion of the respective field shaper; and (3) including a reduced area portion having a height, in the direction of said axes, which is reduced over a predetermined length of the upstanding elongate portion where it extends alongside the central aperture;

the overall length and height of said upstanding elongate portion determining line coma correction substantially independently of field coma correction;

the shape, length and height of the reduced area portion, together with the plate-shaped portion, determining field coma correction substantially independently of line coma correction.

2. A color display tube as in claim 1 where said reduced area portion is formed by including a notch in the upstanding elongate portion.

3. A color display tube as in claim 2 where the notch is substantially rectangular.

4. A color display tube as in claim 2 or 3 where the notch is in an end of the elongate member closest to the screen.

5. A color display tube as in claim 2 or 3 where the notch is in an end of the elongate member closest to the plate.

6. A color display tube as in claim 2 or 3 where each of said first and second elements comprises a single piece of magnetically-permeable material which integrally forms both the plate-shaped portion and the upstanding elongate portion.

7. A color display tube as in claim 1, 2 or 3 where each of said upstanding elongate portions forms an acute angle with the axis of the central electron beam.

8. A color display tube as in claim 7 where said angle is no larger than 45°.

* * * * *